United States Patent [19]

Griffiths

[11] Patent Number: 4,573,725

[45] Date of Patent: Mar. 4, 1986

[54] REMOTE CONTROLLED CRANE HOOK COUPLER

[76] Inventor: Edward E. Griffiths, 3200 Polaris St. #23, Las Vegas, Nev. 89102

[21] Appl. No.: 595,712

[22] Filed: Apr. 2, 1984

[51] Int. Cl.[4] ..... B66C 1/34; B66C 1/66

[52] U.S. Cl. ..... 294/82.28; 24/603; 294/66.2; 294/82.3; 294/905; 403/27; 403/322

[58] Field of Search ..... 294/1 R, 66 A, 83 R, 294/83 A, 83 AA, 83 AB, 86 R, 86 A, 90, 93, 94; 24/603, 607, 635; 285/93; 339/91 B; 403/27, 322; 411/348

[56] References Cited

U.S. PATENT DOCUMENTS

| | | | |
|---|---|---|---|
| 2,763,451 | 9/1956 | Moran | 24/603 X |
| 3,154,337 | 10/1964 | Walker | 294/83 R X |
| 3,319,978 | 5/1967 | Melhose | 294/83 AA X |
| 3,430,305 | 3/1969 | Geffner | 24/603 |
| 4,214,842 | 7/1980 | Franks | 294/66 A X |

FOREIGN PATENT DOCUMENTS

| | | | |
|---|---|---|---|
| 979155 | 4/1951 | France | 294/83 AA |
| 999389 | 1/1952 | France | 294/83 AA |
| 1178336 | 5/1959 | France | 294/83 AA |
| 971537 | 9/1964 | United Kingdom | 411/348 |

*Primary Examiner*—Johnny D. Cherry
*Attorney, Agent, or Firm*—Linval B. Castle

[57] ABSTRACT

A remote operable coupler for rapidly connecting the loading hook of a crane, or the like, to a load to be hoisted comprises a load collar that is attached to the load and an upper unit support on the crane hook. The load collar has a funnel shaped aperture vertically aligned therethrough and the upper unit has a depending lifting tube that is lowered into and through the funnel in the collar. Steel balls are located in radial holes near the bottom of the lifting tube and normally are recessed into an annular groove near the bottom end of a cam rod in the bore of the lifting tube. The cam rod is automatically moved by an actuator controlled by a switch that detects the seating of the lifting tube in the load collar to force the balls outward and against a locking shoulder in the bottom of the load collar funnel, and disengagement of the balls is made by a remote operator by either a radio control signal or an electrical signal that reverses the movement of the linear actuator and the cam shaft thus permitting the balls to fall back into the annular groove.

9 Claims, 4 Drawing Figures

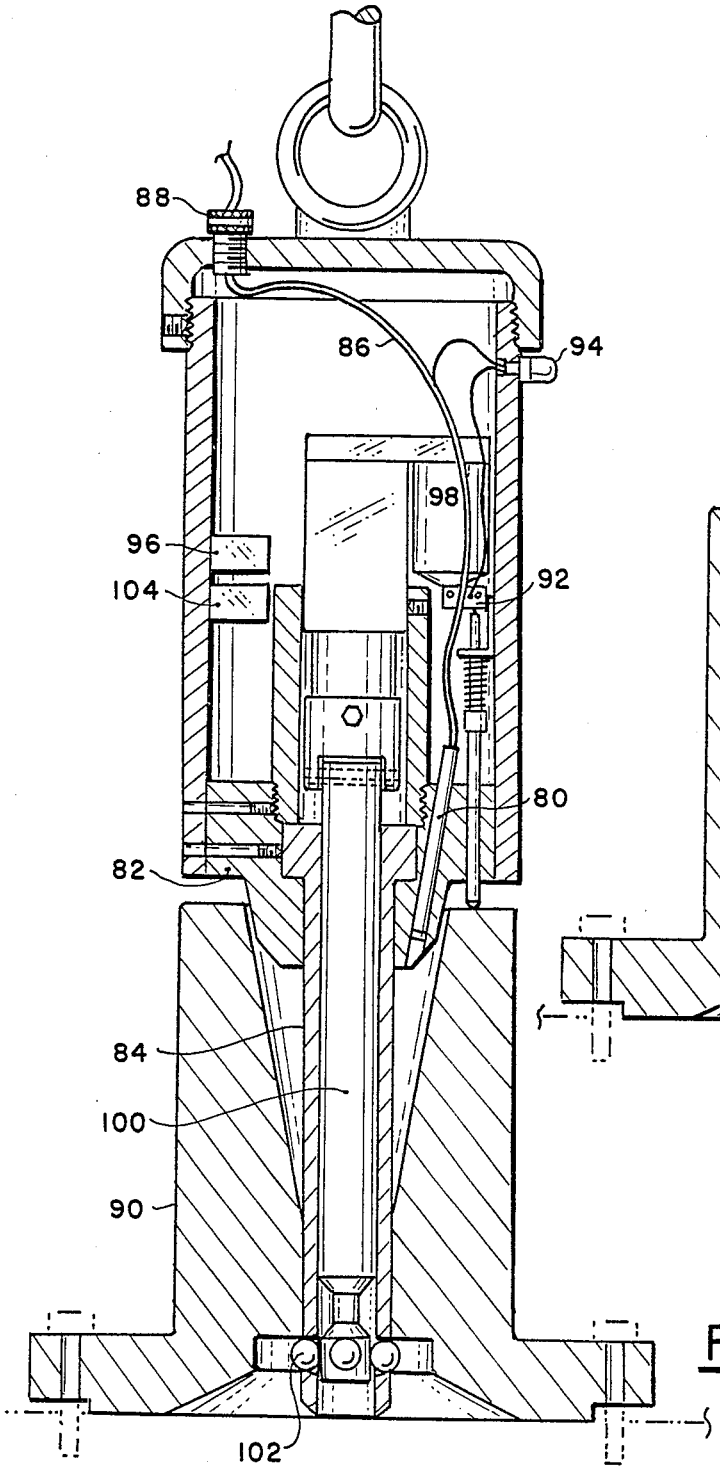
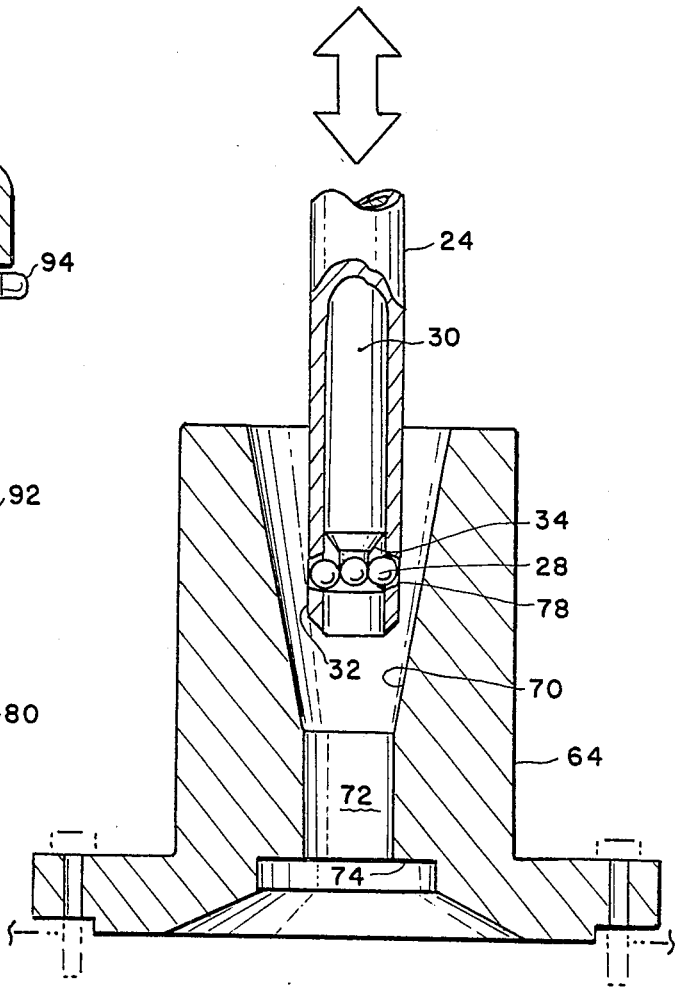
FIG. 2
FIG. 3

REMOTE CONTROLLED CRANE HOOK COUPLER

BRIEF SUMMARY OF THE INVENTION

This invention relates generally to heavy equipment load lifting hooks and in particularly to a remote controlled engaging and releasing load coupler for cranes or the like.

The typical method for coupling a lifting hook on a crane or other load lifting equipment is for the crane operator or a load hooker laborer to climb upon the load to be hoisted to couple the crane hook to a lifting ring or supporting cables around the load. While this method may be adequate for many types of loads, it is often a very hazardous or perhaps impossible if, for example, it is necessary to couple or release a crane hook from a stack of loose lumber, if it becomes necessary to lift a load from a fire or a hot area, if the load is in an explosive or toxic atmosphere, etc.

Briefly described, the load hooker of the invention includes an upper assembly with a top lifting ring for connecting the assembly to a crane hook. An elongated hollow lifting pin axially extends from the lower end of the upper section and is shaped to engage and center itself in a funnel shaped collar attached to the load, to a plate connected to chains or cables around the load, or to other systems that may be hoisted, moved or merely requiring some type of physical connections. Upon the seating of the upper assembly and its lifting pin in the load collar a linear drive mechanism in the upper assembly lifts an inner cam shaft in the hollow lifting pin to force outward through openings in the lifting pin jacket a plurality of balls that are normally recessed in an annular groove in the cam shaft. These extended balls engage a shoulder in the load collar to firmly lock the upper assembly on the crane hook to the load collar to effectively couple the upper assembly and the lifting pin directly to the load to be moved.

A second embodiment of a load hooker is particularly for use in dark areas and includes a small television camera and light sources mounted in the upper assembly and directed down toward the direction of the position of a load collar to guide the crane operator in locating and positioning the load hooker upper assembly.

DESCRIPTION OF THE DRAWINGS

In the drawings which illustrate the preferred embodiment of the invention:

FIG. 2 is a sectional view illustrating the details of the load hooker lifting pin released from the load collar and the location of the engaging balls in the cam shaft;

FIG. 3 is a sectional elevational view of an alternate embodiment of a load hooker having therein a small television camera tube for positioning the hooker from a remote location or in a dark environment.

DESCRIPTION OF THE PREFERRED EMBODIMENT

Figure 1:
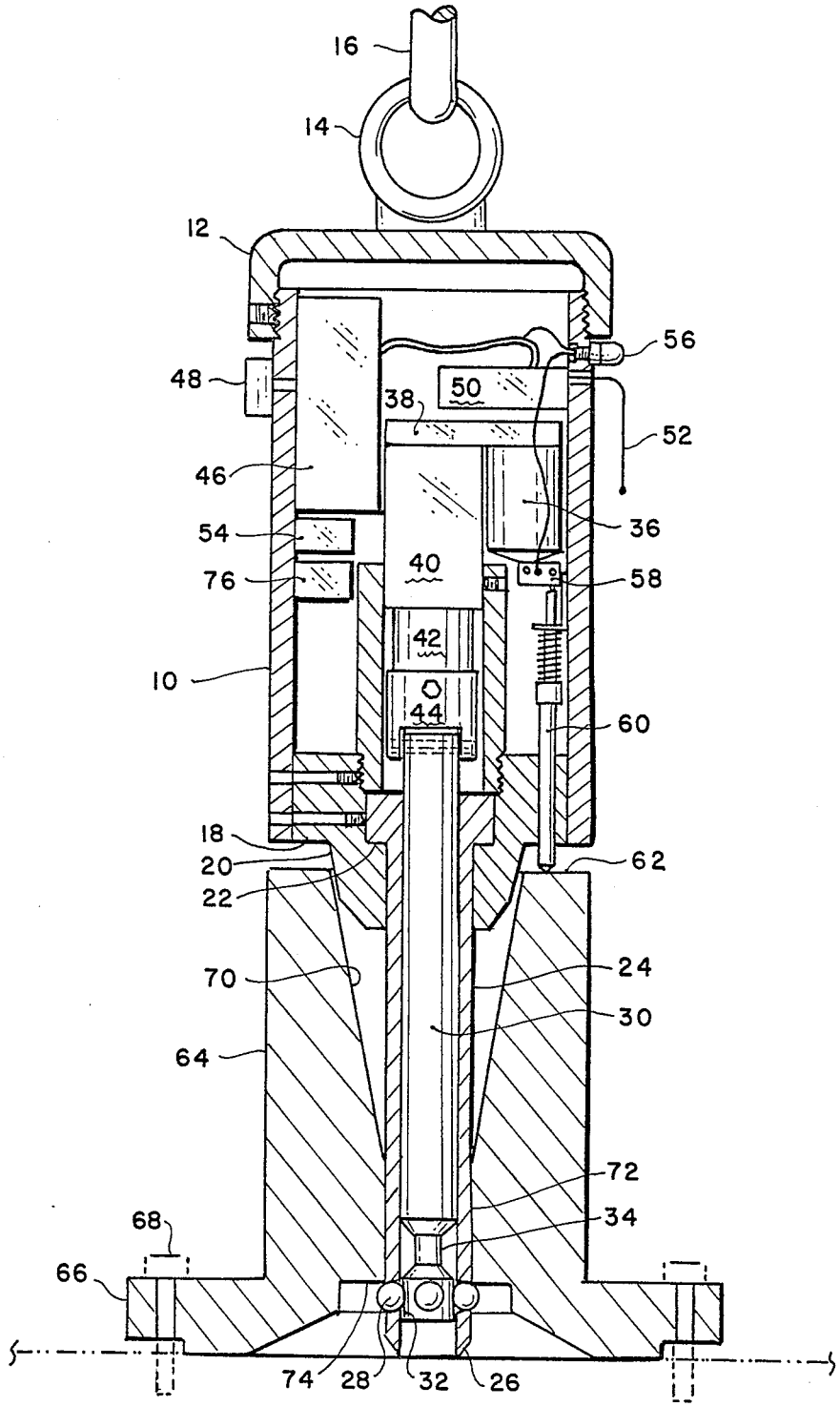
FIG. 1 is a sectional elevational view of the load hooker.

FIG. 1 illustrates in section the load hooker comprising a strong, tubular upper housing 10 having a removeable top end cap 12 firmly attached thereto. Centered on top of the end cap is an attached lifting ring 14 of a suitable size for coupling to a crane hook 16. At the opposite or lower end of the tubular portion of the upper housing and firmly attached thereto is a collar 18 having a conical lower section 20 extending a short distance below the end of the tubular housing 10.

Axially extending from the lower end of the collar 18 and connected through the collar to a supporting annular ledge 22 formed in the bore of the collar is a strong, tubular, elongated, lifting pin 24 having at its lower or distal end a conically shaped end surface 26. An inch or more above the end surface 26 are a plurality of preferably three or four radial holes through the tubular lifting pin 24. As will be explained in detail in connection with FIG. 2, these radial holes permit a like number of steel balls 28 to withdraw into the pin or extend therefrom to engage a load collar to be subsequently described.

Axially located within the bore of the tubular lifting pin 24 is a straight elongated cam shaft 30 having at its lower end a section 32 with a diameter slightly less than the inside diameter of the tubular pin 24 and a length slightly less than the distance between the lower conical end of the pin 24 and the lower edges of the radial holes therethrough that accommodate the balls 28. Above and adjacent the end section 32 of the cam shaft 30 is an annular recessed section 34 having a depth suitable for the complete withdrawal of the balls 28 into the recess and the pin's radial holes as shown in FIG. 2 to be later described.

The linear movement of the cam shaft 30 within the tubular lifting pin 24 is controlled by a linear actuator unit within the upper housing 10 and comprising a reversible motor 36 driving gears in gear box 38 which in turn rotates a drive screw mechanism 40 that extends or retracts the linear movement of the screw 42. The linear moveable screw 42 is coupled through a universal coupling 44 to the upper end of the cam shaft 30. Thus, the operation of the reversible motor 36 linearly moves the cam shaft 30 to either extend the locking balls 28 from their respective radial holes in the pin 24 or withdraw the balls into the annular recess section 34. If preferred, the motor 36 and associated gears 38 and linear actuator 40, 42 may be replaced by a spring biased electromechanical solenoid (not shown) which will operate the cam shaft 30 within the lifting pin 24.

The preferred embodiment of the load hooker includes a battery 46 that may be recharged through a side port 48 in the housing, and a small radio receiver 50 having an antenna 52 extending through a waterproof grommet in the wall of the upper housing. A radio signal from a remote transmitter may thus cause the receiver 50 to energize a DPDT relay 54 within the housing 10 to apply battery power to the reversible D.C. motor 36, or electromechanical solenoid as mentioned above. In either embodiment the control of the cam shaft 30 is directed via radio link from a remote operator who receives a signal that the load hooker is engaged or disengaged from the load by an indicator lamp 56 in the side wall of the upper housing 10. The indicator lamp is energized by the battery 46 in circuit with a microswitch 58 that is closed by a spring biased plunger 60 that slideably extends through the collar 18 along an axis substantially parallel with the axis of the lifting tube 24 but offset therefrom so that the lower end of the plunger 60 may contact the flat top surface 62 of a load collar 64 into which the lifting pin may extend and which now will be discussed.

The load collar 64 is a strong, thick-walled tubular member with a lower circular flange 66 containing a plurality of bolts 68 that may be attached to the top of the load to be hoisted, or to a ring or plate to which loading chains or cables may be attached. Axially extending down from the top flat surface 62 of the collar is conical shaped funnel 70 having a conical angle somewhat similar to that in the lower end of the upper section collar 18. The apex end of the funnel is bored with an axial straight hole 72 having a diameter slightly larger than the outer diameter of the lifting pin 24, and the lower end of the axial hole 72 in the flange 66 is counterbored to provide a flat shoulder 74 against which the lifting pin balls 28 may engage the load collar.

In operation, the load hooker with the load collar engaging balls recessed in the annular section 34 of the cam shaft 30 is lowered toward the funnel 70 in the load collar which is attached to a load to be lifted. The lifting pin, contacting any part of the funnel wall, will guide itself down and through the axial apex hole to the point at which the balls may be extended to engage the shoulder 74 in the counterbored lower surface of the load collar 64. At this point, the end of the plunger 60 will have contacted the top flat surface 62 of the load collar 64 and will have moved to close the microswitch 58 which simultaneously energizes the indicator lamp 56 and the relay 54. The closing of the relay 54 energizes the motor 36, or solenoid (not shown), in a first direction that will cause the cam shaft 30 to raise up in the tubular lifting pin 24 to force the load collar engaging balls 28 outward to firmly lock the load hooker to its load collar. The lamp 56 indicates to a remote operator that the load hooker is engaged. When it is desired to release the load, the operator transmits a signal to the receiver 50 which triggers a second relay 76 that reverses the polarity of the power to the motor and drives it in its reverse direction to lower the cam shaft 30 and to retract the balls 28 from their engagement on the shoulder 74 in the bottom surface of the load collar 64.

FIG. 2 is a sectional view illustrating in detail the load collar 64 with the lifting pin 24 poised above, either before or after insertion of the lifting pin in the axial collar hole 72 at the bottom of the conical funnel 70. The cam shaft 30 has been lowered in the bore of the tubular lifting pin to permit the several load collar engaging balls 28 to fall into the annular recessed section 34 near the lower end of the cam shaft so that no surface of any ball extends out beyond the outer surface of the tubular lifting pin 24. It will be noted that the radial holes 78 in the walls of the lifting pin are conical with the minimum diameter of a hole at the outer surface of the lifting pin and having a diameter slightly less than the diameter of a ball 28 to both prevent the loss of the balls through the holes 78 and also to cause the balls to drop back into the annular recess 34.

In the embodiment disclosed in FIGS. 1 and 2 the load hooker has been described with the load collar 64 attached to a load to be hoisted and the upper housing 10 having a lifting ring 14 so that it may be supported from a crane hook. There may be times when it may be desired to reverse the positions of these members so that the collar 64 with its conical funnel aperture 70 would be lowered to engage the lifting pin 74 which extends vertically upward from the housing 10 which is connected to the load to be hoisted. This is quite possible with the embodiment of FIGS. 1 and 2 which employs the rechargable, self contained battery system for operation of the linear actuator in response to the closure of the microswitch and the disengagement signal from the radio receiver, but is not a convenient method of operation in the embodiment to be now described.

FIG. 3 is a sectional view illustrating a second embodiment of the load hooker that is substantially identical with that of FIG. 1, but equipped with a small television camera tube 80 mounted in the collar 82 at an angle with respect to the longitudinal axis of the load hooker so that it will view the lower end of the lifting pin 84 and the area toward which the load hooker would be lowered. The camera tube 80 is used in the load hooker whenever the load to be hoisted is out of the vision of the operator such as, for example, a load in a well or quarry, or during operations at night or in dark areas. Not illustrated in FIG. 3 are small illuminating lamps that are mounted at two or three points around the collar 82 and at angles suitable for providing adequate lighting for the camera tube when the load hooker is being used in such dark areas.

The television camera tube 80 in the embodiment of FIG. 3 is coupled to the crane operator's monitor by a suitable cable 86 that is passed through a water-tight, strain-relief, collar 88 in the upper housing or removeable top cap of the load hooker. Inasmuch as the embodiment of FIG. 3 requires that one conductor pair must be introduced from the outside for use with the camera tube 80, additional conductor pairs may also introduce outside power to the load hooker to replace the internal power pack and some of the controls used in the embodiment of FIG. 1. Therefore, the battery pack 46 and the radio receiver 50 of FIG. 1 have been eliminated from the embodiment of the load hooker illustrated in FIG. 3.

The operation of the embodiment illustrated in FIG. 3 is similar to that illustrated in FIG. 1. Using the camera tube 80 the operator can readily see to place the lifting pin 84 into the funnel of the load collar 90. When properly seated therein, the plunger closed microswitch 92 signals the contact by the indicator light 94 and also applies excitation to the relay 96 which actuates the linear drive motor 98 causing the cam shaft 100 to raise and force the balls 102 outward to engage the shoulder in the base of the load collar 90. When ready for release, the operator applies a signal that closes the relay 104 which applies a reversed polarity power to the motor 98 to lower the cam shaft 100 and permit the engaging balls to drop into the annular recess in the end of the cam shaft.

In many instances, it may be desired to detect the point at which the load hooker lifting pin first approaches engagement with a load collar and just prior to a locking engagement by the extending locking balls. Such information may be desired, for example, for starting motors, external sensing, robotic or various timing apparatus associated with the load hoisting.

Figure 4:
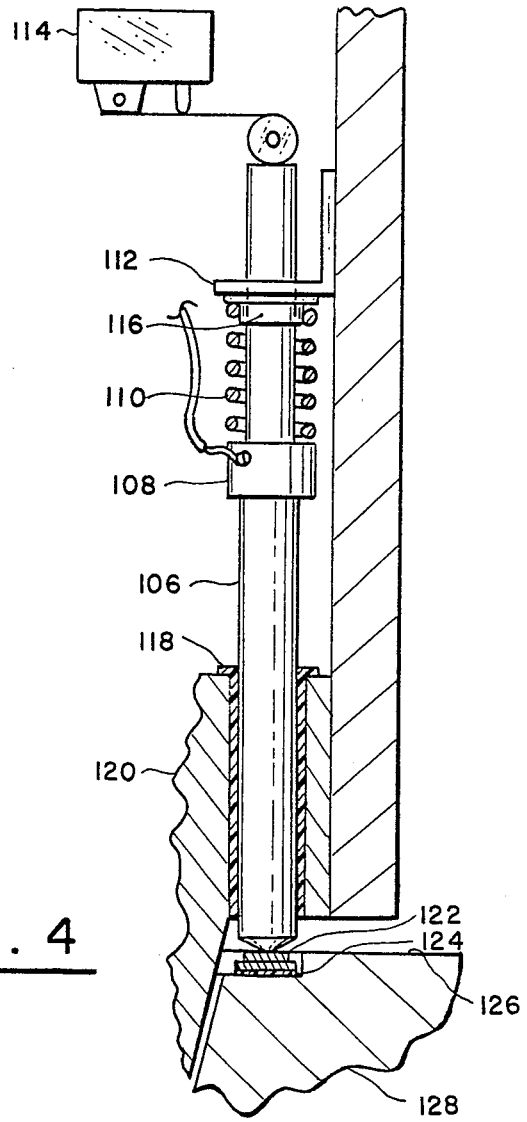
FIG. 4 is sectional view illustrating a means for signalling the approach of a full connection of the upper assembly of the hooker to the load collar.

FIG. 4 is a sectional view illustrating such a pre-engagement alarm that includes an electrically conductive plunger 106 having at its top end a collar 108 for supporting the spring 110 that biases the plunger downward away from a supporting angle bracket 112 that is attached to the inner housing wall of the load hooker. The portion of the plunger above the plunger collar 108 is electrically non-conductive and extends from the collar 108, through an insulated collar 116 and a hole in the angle bracket 112, and to the actuating arm on the microswitch 114 which, as previously described, closes a relay that starts the upward movement of the liner actuator and the cam shaft. The biasing spring 110 is therefore compressed between the stationary insulated collar 116 and the plunger collar 108.

The conductive plunger 106 is slideable within an insulating bushing 118 in the load hooker upper collar 120 and extends down so that its end will contact a copper ring 122 that is cemented to a similar insulation ring 124 mounted in an annular groove in the top flat surface 126 of a load collar 128. Both the insulation ring 124 and the conductive copper ring 122 therefore completely encircle the funnel opening in the top of a load collar 128. The conductive ring 122 is connected to a suitable insulated conductor (not shown) that extends through a radial slot formed in the surface 126 of the load collar to the desired pre-engagement alarm mechanism. Thus, the conductive plunger 106 and the copper ring 122 form an electrical pre-engagement alarm switch which is closed by plunger contact with the ring.

I claim:

1. A coupler controllable from a remote position for interconnecting a first member of said coupler that is attachable to a lifting device to a second member of said coupler that is attachable to a load to be lifted, said coupler comprising:

the second member, said second member having a funnel shaped aperture on a substantially vertical axis, the broad end of said funnel shaped aperture being directable toward the first member of said coupler, the apex end of said funnel shaped aperture terminating in a base portion having an aperture coaxial with said funnel shaped aperture and connected therewith, said base portion having a substantially horizontal shoulder adjacent said base portion coaxial aperture and coaxial therewith;

the first member, said first member having an elongated tubular member extending from one end thereof upon a substantially vertical axis and directable toward said funnel shaped aperture in said second member, the distal first end of said tubular member having an outer diameter adapted to pass through said funnel shaped aperture and through the aperture in the base portion of said second member, said tubular member having near said distal first end a ring of radial holes of predetermined diameter through the wall of said tubular member;

a cam shaft extending from said first member and slideably extending within the bore of said elongated tubular member to a first shaft end at the distal first end of said tubular member, said cam shaft having at said first shaft end an annular ring having a diameter substantially equal to the inside diameter of said tubular member and an annular groove adjacent said annular ring and at a position corresponding to said ring of radial holes through the wall of said tubular member;

a plurality of balls each having a diameter slightly greater than the predetermined diameter of said radial holes through the wall of said tubular member, one ball of said plurality being positioned in a corresponding one of said radial holes and in said annular groove in said cam shaft; and engaging means including an electrically operated linear actuator in said first member for sliding said cam shaft in a first direction in the bore of said tubular member whereby said annular ring at said first shaft end will force said plurality of balls from said annular groove and partially through the radial holes through said tubular member to a position that will engage the shoulder in the base portion of said second member, said engaging means further including a switch actuated by the seating of said first member into said second member, said switch in circuit with said linear actuator for actuating said linear actuator to slide said tubular member in said first direction.

2. The coupler claimed in claim 1 further including disengaging means within said first member and responsive to a signal from a remote location for actuating said electrically operated linear actuator to slide said cam shaft in a second direction in the bore of said tubular member to align said annular groove with said radial holes to thereby permit said balls to retract into said groove and disengage from said coaxial shoulder in the base portion of said second member.

3. The coupler claimed in claim 2 wherein said linear actuator is battery operated and is responsive to a disengaging signal detected by a radio receiver within said first member.

4. The coupler claimed in claim 2 wherein said second member has a substantially flat horizontal surface surrounding the broad end of said funnel shaped aperture, and said first member has a tubular member attachment collar having a flat horizontal ring adapted to contact the horizontal surface on said second member when the first end of said tubular member has passed through the apex of said funnel shaped aperture and the coaxial aperture in the base portion of said second member.

5. The coupler claimed in claim 4 wherein said engaging means includes a spring biased push rod slideably located in said tubular member attachment collar and on an axis substantially parallel with the longitudinal axis of said tubular member, the first end of said push rod extending from the flat ring of said collar for contacting the flat surface of said second member, the second end of said push rod contacting a spring return electrical switch which, upon closure, operates a motor driven linear actuator coupled to said cam shaft for driving said cam shaft in the first direction.

6. The coupler claimed in claim 5 further including a television camera tube located in said tubular member attachment collar, said tube being directed toward a point on the axis of said tubular member and ahead of the first end thereof for directing the connection of said first and second members by a remote operator viewing the area covered by said camera tube.

7. The coupler claimed in claim 6 wherein said first member includes means at the end opposite said tubular member for supporting said first member from a crane hook.

8. The coupler claimed in claim 7 wherein said second member includes means for attaching said second member to a load to be lifted.

9. The coupler claimed in claim 8 wherein said push rod is electrically conductive and is insulated from said tubular member attachment collar and from said first member of said coupler, and wherein said second member of said coupler includes an electrically conductive ring on the top flat surface thereof and insulated therefrom whereby contact between said electrically conductive push rod and said conductive ring closes an electrical circuit signalling the approach of seating of said first member into said second member.

* * * * *